US009843094B2

(12) United States Patent
Tadokoro et al.

(10) Patent No.: US 9,843,094 B2
(45) Date of Patent: Dec. 12, 2017

(54) GLASS ANTENNA FOR VEHICLE

(75) Inventors: Shingo Tadokoro, Watarai-gun (JP); Takayuki Suzuki, Taki-gun (JP)

(73) Assignee: Central Glass Company, Limited, Ube-shi (JP)

( * ) Notice: Subject to any disclaimer, the term of this patent is extended or adjusted under 35 U.S.C. 154(b) by 130 days.

(21) Appl. No.: 14/124,498

(22) PCT Filed: Jun. 22, 2012

(86) PCT No.: PCT/JP2012/065967

§ 371 (c)(1),
(2), (4) Date: Dec. 6, 2013

(87) PCT Pub. No.: WO2013/002134

PCT Pub. Date: Jan. 3, 2013

(65) Prior Publication Data

US 2014/0132464 A1 May 15, 2014

(30) Foreign Application Priority Data

Jun. 27, 2011 (JP) ..... 2011-141858

(51) Int. Cl.
*H01Q 1/32* (2006.01)
*H01Q 1/12* (2006.01)
(Continued)

(52) U.S. Cl.
CPC ..... *H01Q 1/3208* (2013.01); *H01Q 1/1271* (2013.01); *H01Q 5/371* (2015.01); *H01Q 5/378* (2015.01)

(58) Field of Classification Search
CPC ..... H01Q 1/3208; H01Q 5/378; H01Q 1/1271
(Continued)

(56) References Cited

U.S. PATENT DOCUMENTS 5,229,780 A * 7/1993 Hirotsu ..... H01Q 1/1271 343/713
5,905,470 A * 5/1999 Fujii ..... H01Q 1/1271 343/711

(Continued)

FOREIGN PATENT DOCUMENTS

JP 62-61511 U 4/1987
JP 10-4308 A 1/1998

(Continued)

OTHER PUBLICATIONS

International Search Report with English translation dated Sep. 4, 2012 (5 pages).

*Primary Examiner* — Dieu H Duong
*Assistant Examiner* — Bamidele A Jegede
(74) *Attorney, Agent, or Firm* — Crowell & Moring LLP

(57) ABSTRACT

A glass antenna provided on vehicle side glass has a power feeding portion disposed at side portion of the side glass, a main element connected to the power feeding portion and a square bracket-shaped element whose one end is connected to some midpoint of the main element. When frequency band of FM broadcast wave received by the antenna is divided into two frequency bands with respect to its center frequency, wavelength of center frequency of frequency band of low frequency is λ, and wavelength of center frequency of frequency band of high frequency. Also wavelength shortening coefficient of the side glass is α. In this condition, either one of length of the main element or length from the power feeding portion up to an opening end of the square bracket-shaped element is set to α·λ·¾, and the other is set to α·λ'·¾.

4 Claims, 4 Drawing Sheets

(51) Int. Cl.
*H01Q 5/371* (2015.01)
*H01Q 5/378* (2015.01)

(58) Field of Classification Search
USPC ..... 343/713
See application file for complete search history.

(56) References Cited

U.S. PATENT DOCUMENTS 7,825,865 B2 * 11/2010 Ibe ..... H01Q 1/1271 343/713
2004/0113855 A1 * 6/2004 Yang ..... H01Q 21/28 343/713
2004/0164913 A1 * 8/2004 Ogino ..... H01Q 1/1271 343/713
2005/0024279 A1 * 2/2005 Kuehne ..... H01Q 1/1271 343/713
2005/0140555 A1 * 6/2005 Fujii ..... H01Q 1/1278 343/704
2005/0156798 A1 * 7/2005 Bally ..... H01Q 1/1271 343/713
2008/0316143 A1 * 12/2008 Chen ..... H01P 5/103 343/893
2011/0012799 A1 * 1/2011 Saito ..... H01Q 1/1271 343/713
2011/0115681 A1 * 5/2011 Oshima ..... H01Q 1/1278 343/713

FOREIGN PATENT DOCUMENTS

JP 10-13126 A 1/1998
JP 10-13127 A 1/1998
JP 2000-269717 A 9/2000

* cited by examiner

GLASS ANTENNA FOR VEHICLE

TECHNICAL FIELD

The present invention relates to a glass antenna provided on a side glass of a vehicle and relates to a glass antenna for the vehicle which is suitable to receive radio wave of FM radio broadcast wave.

BACKGROUND ART

Frequency band for the FM radio broadcast in Japan is 76 MHz~90 MHz, and frequency band for the FM radio broadcast except Japan is 88 MHz~108 MHz.

For instance, as disclosed in a related art of Japanese Patent Provisional Publication No. 10-13127 (JP10-13127), in a vehicle having a large-sized side glass, a glass antenna to receive FM broadcast wave and AM broadcast wave is provided on the side glass (Patent Document 1).

With respect to the FM broadcast wave, in general, by adjusting a length of the antenna to establish resonance with a frequency band of the FM broadcast wave, a good reception gain can be obtained. With regard to the AM broadcast wave, as shown by a circle drawn by a dotted line which encircles a conductive line in FIGS. 12A and 12B, the conductive line each has a reception effective area for AM wave, and it is generally known that the greater the an area encircled by this circle, the more suitably the AM broadcast wave can be received. For instance, as compared with FIG. 12B in which two reception effective areas of a horizontal part of each conductive line located at a lower side of the side glass overlap with each other, a reception effective area of the glass antenna provided on the side glass for the AM broadcast wave as shown in FIG. 12A in which the two reception effective areas of the horizontal part of each conductive line do not overlap with each other becomes greater.

Regarding the glass antenna for the vehicle disclosed in the Patent Document 1, it is an antenna that can receive both of the FM radio broadcast wave and the AM radio broadcast wave by the fact that a conductive line connecting to a power feeding portion that is disposed at a corner part of the side glass is set to form an S-shape. For the FM broadcast wave, by arranging the conductive line so as to form the S-shape on the side glass, a sufficient length of this antenna to establish resonance with the frequency band of the FM broadcast wave can be obtained. In addition, for the AM broadcast wave, by disposing a part of the S-shaped conductive line so as to extend in the middle of the side glass, the reception effective area of the conductive line of this antenna can be increased.

Further, in this antenna, by connecting an auxiliary line to the S-shaped conductive line and matching an input impedance of the power feeding portion of this antenna with a characteristic impedance of a power feeding line connected to the power feeding portion, the reception gain of the FM broadcast wave can be increased.

CITATION LIST

Patent Document

Patent Document 1: Japanese Patent Application Publication No. JP10-13127

SUMMARY OF THE INVENTION

Technical Problem

In the antenna disclosed in the Patent Document 1, however, there could be a case where a high reception gain can not be obtained over the full range of a desired frequency band of the FM broadcast wave, depending on a shape of the side glass or depending on the vehicle having the side glass.

The present invention solves this problem. That is, the present invention is aimed at providing the glass antenna for the side glass which is capable of obtaining the high reception gain over the full range of the desired frequency band of the FM broadcast wave.

Solution to Problem

A glass antenna of the present invention is a glass antenna of a vehicle for receiving FM broadcast wave, which has a power feeding portion provided at a side portion of a side glass of the vehicle and a main element connected to the power feeding portion. Further, the glass antenna of the present invention has a square bracket-shaped element arranged at an outer side of the main element. And one end of the square bracket-shaped element is connected to some midpoint of the main element.

Then, when a wavelength of a center frequency of frequency band of a low frequency with respect to a center frequency of frequency band of the FM broadcast wave received by the glass antenna is $\lambda$ and a wavelength of a center frequency of frequency band of a high frequency with respect to the center frequency of frequency band of the FM broadcast wave received by the glass antenna is $\lambda'$, and also when a wavelength shortening coefficient of the side glass is $\alpha$, and further when a length of the main element is L1, a length of the square bracket-shaped element is L2 and a length from the some midpoint of the main element at which the square bracket-shaped element is connected up to the power feeding portion is L3, these L1, L2 and L3 are set so as to satisfy a following relationship; $L1=\alpha\cdot\lambda\cdot 3/4$, $L2+L3=\alpha\cdot\lambda'\cdot 3/4$ or $L1=\alpha\cdot\lambda'\cdot 3/4$, $L2+L3=\alpha\cdot\lambda\cdot 3/4$.

Further, by arranging a part of the main element so as to extend from one side portion up to an opposite side portion of the side glass in a lateral direction on a center line of the side glass or in close proximity to the center line of the side glass, a good reception performance of AM broadcast wave can be obtained.

Furthermore, by arranging the dummy element to be parallel to a part of the square bracket-shaped element where the square bracket-shaped element does not extend along the main element, an appearance of the glass antenna of the present invention can be enhanced.

In the present invention, it is preferable that the square bracket-shaped element be arranged at a clearance of 10 mm or more from a flange peripheral edge of the vehicle where the side glass is mounted.

In the present invention, it is preferable that a part of the square bracket-shaped element which extends along the main element be arranged at a distance of 10 mm or more from the main element.

Effects of the Invention

According to the present invention, the length of one of two elements, which are provided on the side glass and form the glass antenna for the vehicle, is adjusted to the wavelength of the center frequency on the lower frequency band side of the desired frequency band of the FM broadcast wave, and the other of the two elements is adjusted to the wavelength of the center frequency on the higher frequency band side of the desired frequency band of the FM broadcast wave. Then, by properly connecting these two elements and properly arranging these two elements on the side glass, the high reception gain can be obtained over the full range of the desired frequency band of the FM broadcast wave.

EMBODIMENTS FOR CARRYING OUT THE INVENTION

<General Configuration of the Present Invention>

Figure 1:
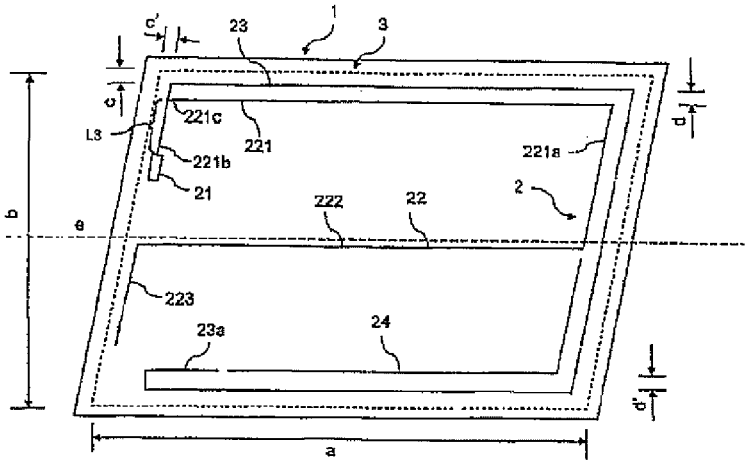
FIG. 1 is a front view of a glass antenna for a vehicle according to an embodiment 1.

A glass antenna 2 of the present invention is an antenna as shown by a front view of a side glass 1, viewed from a vehicle exterior side, in FIG. 1. The glass antenna 2 of the present invention has a power feeding portion 21, a main element 22 and a square bracket-shaped element 23 on the side glass 1 that is mounted on or fitted into a side flange of a vehicle. The square bracket-shaped element 23 is arranged at an outer side of the main element 22. Further, the glass antenna 2 could have a dummy element 24.

The power feeding portion 21 can be provided at a side portion of the side glass 1, for instance, at a left side portion of the side glass 1. One end of the main element 22 is connected to the power feeding portion 21, and the other end of the main element 22 is open. With regard to the square bracket-shaped element 23, its one end is connected to some midpoint of the main element 22, and the square bracket-shaped element 23 is arranged at the outer side of the main element 22 so as to extend along a periphery of the side glass 1.

The dummy element 24 is an element provided with the aim of enhancing an appearance of the antenna. The dummy element 24 is not connected to the main element 22 nor the square bracket-shaped element 23. The dummy element 24 is arranged so as to extend along a part of the square bracket-shaped element 23 where the square bracket-shaped element 23 does not extend along the main element 22.

Then, a length of the main element 22 and a length of the square bracket-shaped element 23 are determined as follows. That is, when a wavelength of a center frequency of frequency band of a low frequency with respect to a center frequency of frequency band of FM broadcast wave received by the glass antenna 2 is $\lambda$ and a wavelength of a center frequency of frequency band of a high frequency with respect to the center frequency of frequency band of the FM broadcast wave received by the glass antenna 2 is $\lambda'$, and also when a wavelength shortening coefficient (or a wavelength compaction ratio) of the side glass 1 is $\alpha$, either one of the length of the main element 22 or a length obtained by adding a length from the power feeding portion 21 up to a connecting point between the main element 22 and the square bracket-shaped element 23 to the length of the square bracket-shaped element 23 is adjusted to almost $\alpha \cdot \lambda \cdot 3/4$, and the other is adjusted to almost $\alpha \cdot \lambda' \cdot 3/4$. Further, a position of the connecting point of the square bracket-shaped element 23 with the main element 22 is adjusted. With these setting, it is possible to obtain a high reception gain over a full range of a desired frequency band of the FM broadcast wave.

<Pattern of Main Element>

The main element 22 has a first line 221 that extends straight in a lateral direction, a second line 222 that extends straight in the lateral direction and a third line 223 that extends in a longitudinal direction. In FIG. 1, the power feeding portion 21 is disposed at the left side portion of the side glass 1. Then, in a case where the main element 22 is elongated from the power feeding portion 21 in a direction of an upper side of the side glass 1, each line of the main element 22 is arranged in a clockwise direction from the power feeding portion 21 up to a connecting point between the second line 222 and the third line 223.

The first line 221 is a line whose one end is connected to the power feeding portion 21. In FIG. 1, the first line 221 is arranged at the upper side of the side glass 1, and left and right end portions of the first line 221 are bent. A first bending portion 221*a* of the first line 221, which is disposed so as to extend along a right side of the side glass 1, and a second bending portion 221*b* of the first line 221, which is disposed so as to extend along a left side of the side glass 1, are formed on the side glass 1. A top end of the first bending portion 221*a* of the first line 221 is connected to one end of the second line 222, and a top end of the second bending portion 221*b* of the first line 221 is connected to the power feeding portion 21.

The second line 222 is positioned in a middle of the side glass 1 with respect to the first line 221. The second line 222 is arranged parallel to the upper side of the side glass 1, and extends or reaches up to both left and right sides of the side glass 1. The one end of the second line 222 is connected to the top end of the first bending portion 221*a* of the first line 221, and another one end (the other end) of the second line 222 is elongated up to the left side portion of the side glass 1 and connected to a top end of the third line 223.

The third line 223 is arranged so as to extend along the left side of the side glass 1. One end of the third line 223 is connected to the top end of the second line 222, and the third line 223 is elongated in a direction moving away from the power feeding portion 21, then another one end (the other end) of the third line 223 is open.

[Relationship Between Power Feeding Portion and Main Element]

The power feeding portion 21 is disposed not only at the left side portion of the side glass 1, but as shown in FIGS.

Figure 8:
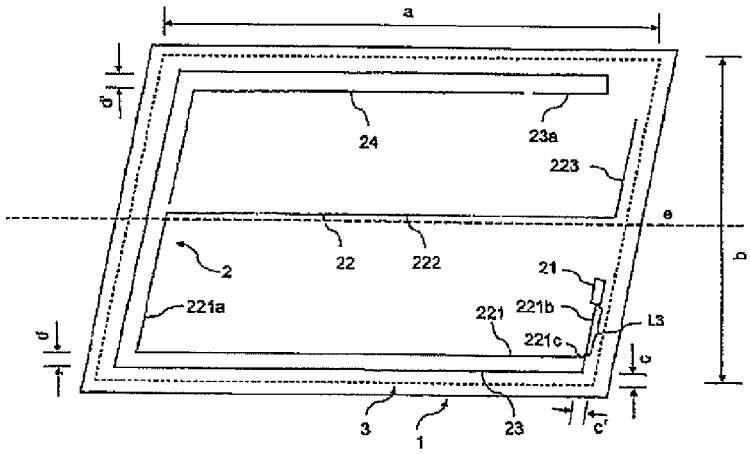
FIG. 8 is a front view of a glass antenna for the vehicle according to an embodiment 8.
Figure 9:
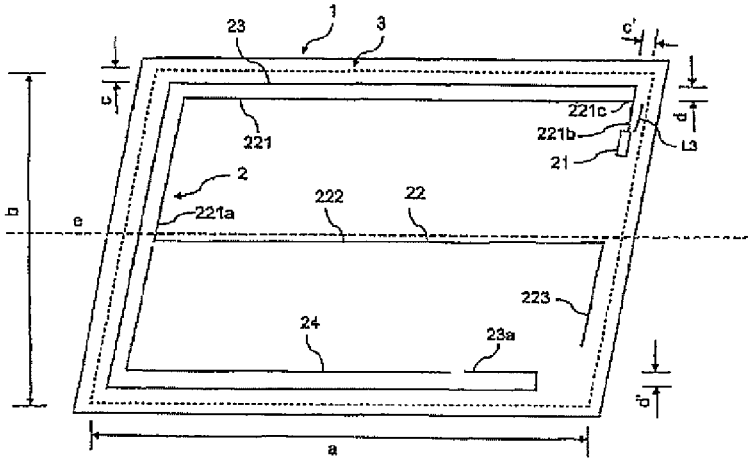
FIG. 9 is a front view of a glass antenna for the vehicle according to an embodiment 9.

8 and 9, the power feeding portion 21 could be disposed also at a right side portion of the side glass 1. In a case where, as shown in FIG. 9, the power feeding portion 21 is disposed at the right side portion of the side glass 1 and the main element 22 is elongated from the power feeding portion 21 in a direction of the upper side of the side glass 1, each line of the main element 22 is arranged in a counterclockwise direction from the power feeding portion 21 up to the connecting point between the second line 222 and the third line 223. Further, in a case where, as shown in FIG. 8, the power feeding portion 21 is disposed at the right side portion of the side glass 1 and the main element 22 is elongated from the power feeding portion 21 in a direction of a lower side of the side glass 1, each line of the main element 22 is arranged in a clockwise direction from the power feeding portion 21 up to the connecting point between the second line 222 and the third line 223.

Figure 4:
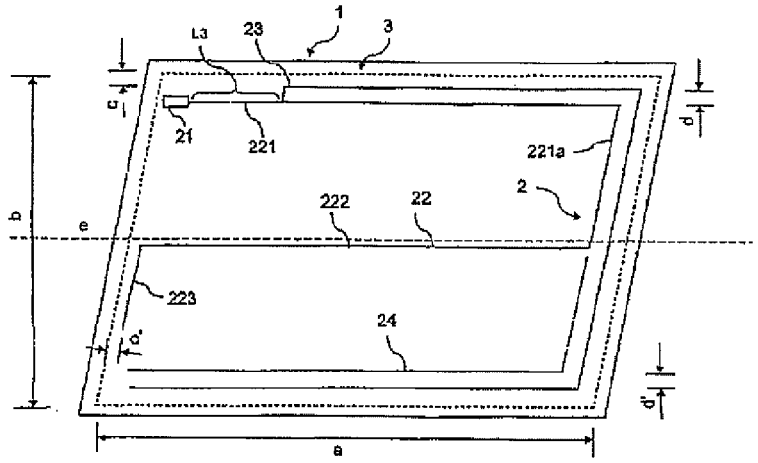
FIG. 4 is a front view of a glass antenna for the vehicle according to an embodiment 4.

Further, as shown in FIG. 4, the power feeding portion 21 could be disposed at a corner part of the side glass 1. In this case, in order for the first line 221 of the main element 22 to connect to the power feeding portion 21, there is no need to form the second bending portion 221*b* of the first line 221. The first line 221 is elongated straight from the power feeding portion 21 along one of the upper side or the lower side of the side glass 1 where the power feeding portion 21 is disposed along the side of the side glass 1.

[Position of Second Line of Main Element]

Figure 6:
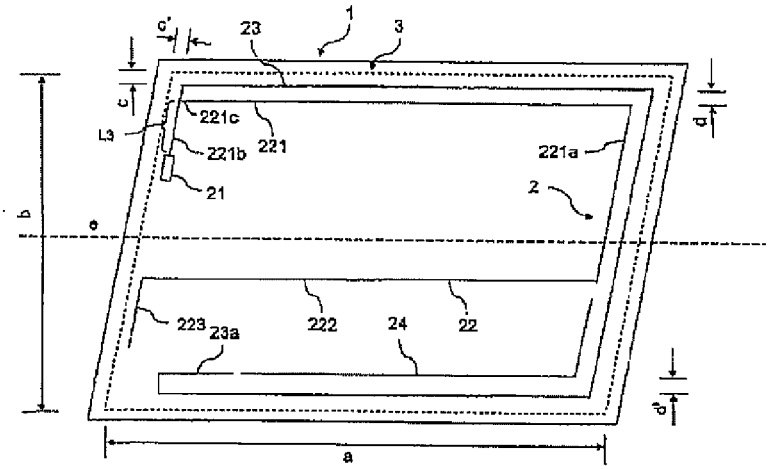
FIG. 6 is a front view of a glass antenna for the vehicle according to an embodiment 6.
Figure 7:
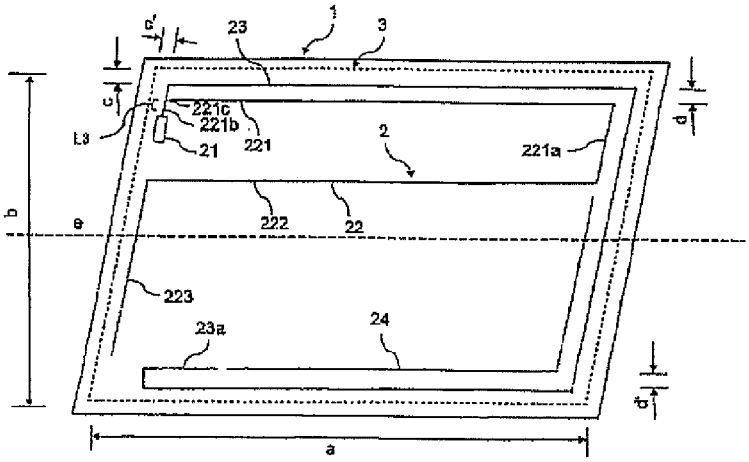
FIG. 7 is a front view of a glass antenna for the vehicle according to an embodiment 7.
Figure 12A:
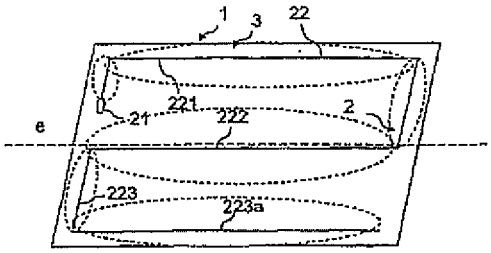
FIGS. 12A and 12B are reference examples for explaining a reception effective area for AM broadcast wave.
Figure 12B:
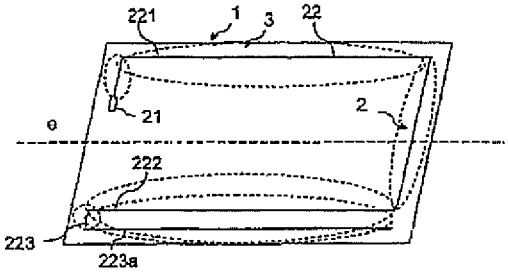

A position of the second line 222 of the main element 22 greatly affects a reception performance of the AM broadcast wave. As shown in FIGS. 6 and 7, with respect to the FM broadcast wave, even if the second line 222 is positioned at a position that is separate from a center line e of the side glass 1 which is parallel to the upper side of the side glass 1, a reception performance of the FM broadcast wave is not greatly affected. However, with regard to the AM broadcast wave, as shown in FIGS. 12A and 12B, each line of the main element 22 has a reception effective area for AM broadcast wave as indicated by an area encircled by a dotted line (a dotted circle). Thus, as shown in FIG. 12B, if the lines of the main element 22 overlap with each other, the reception effective area of the glass antenna 2 becomes small then the reception performance of the AM broadcast wave lowers, as compared with the case where, as shown in FIG. 12A, the lines of the main element 22 are separate from each other.

Therefore, as shown in FIGS. 1 to 5 and FIGS. 8 and 9, when the second line 222 is arranged in close proximity to the center line e of the side glass 1, the reception effective area for AM broadcast wave can be a maximum. Hence, as compared with FIGS. 6 and 7 in which the second line 222 is positioned at the position that is separate from the center line e of the side glass 1, it is possible to receive the AM broadcast wave more suitably.

[Pattern of Third Line of Main Element]

Figure 5:
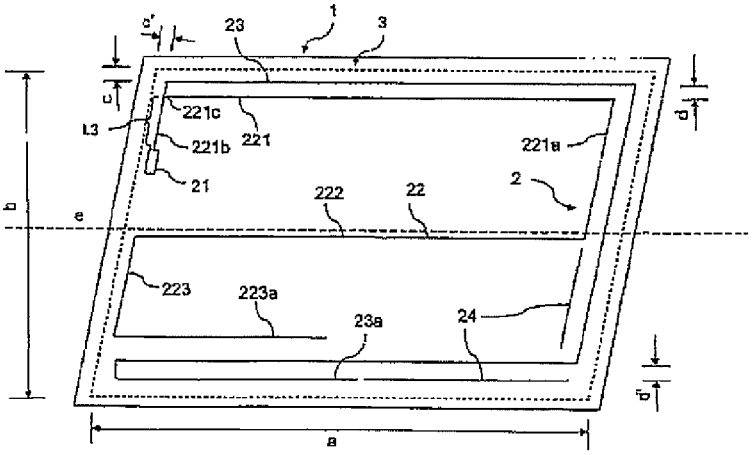
FIG. 5 is a front view of a glass antenna for the vehicle according to an embodiment 5.

As a pattern of the third line 223 of the main element 22, as shown in FIG. 1, an entire length of the third line 223 is elongated along the side portion of the side glass 1, or as shown in FIG. 5, a top end of the third line 223 is bent. This is because the length of the main element 22 is set to $\alpha\cdot\lambda\cdot 3/4$ or $\alpha\cdot\lambda'\cdot 3/4$ in accordance with a size of the side glass on which the glass antenna 2 is provided.

<Square Bracket-Shaped Element>

With regard to the square bracket-shaped element 23, for instance, as shown in FIG. 1, it is connected to a bending point 221*c* of the second bending portion 221*b* of the first line 221 of the main element 22. Further, the square bracket-shaped element 23 is elongated along the upper side of the side glass 1 at the outer side of the first line 221, is bent at a right upper side portion corner part of the side glass 1, and is elongated along the right side of the side glass 1, and further is bent at a right lower side portion corner part of the side glass 1, then is elongated along the lower side of the side glass 1.

Figure 3:
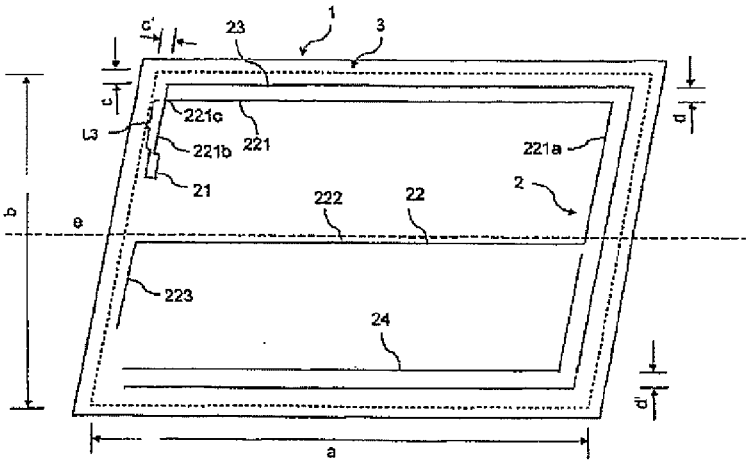
FIG. 3 is a front view of a glass antenna for the vehicle according to an embodiment 3.

Since the length of the square bracket-shaped element 23 is almost $\alpha\cdot\lambda\cdot 3/4$ or almost $\alpha\cdot\lambda'\cdot 3/4$, in order for the length of the square bracket-shaped element 23 to be set to one of these lengths in accordance with the size of the side glass 1, by turning back a top end portion of the square bracket-shaped element 23 as shown in FIG. 1 or only elongating the top end portion of the square bracket-shaped element 23 straight without turning back the top end portion of the square bracket-shaped element 23 as shown in FIGS. 3 and 4, an adjustment of the length of the square bracket-shaped element 23 is made.

[Connecting Point Between Square Bracket-Shaped Element and Main Element]

A distance of the connecting point between a top end of the square bracket-shaped element 23 and the main element 22 from a power feeding point is important to properly match an impedance at the power feeding portion 21 of the present invention with the power feeding point.

In FIG. 1, the connecting point is provided at the bending point 221*c* of the second bending portion 221*b* of the first line 221. With this setting, since the main element 22 and the square bracket-shaped element 23 are arranged with these elements being parallel to each other along the upper side of the side glass 1 from the left side portion to the right side portion of the side glass 1, as compared with a case where, e.g. as shown in FIG. 4, the square bracket-shaped element 23 is connected to a position of the first line 221, except the both left and right side portions, at which a desired reception gain can be obtained, the appearance of the antenna can be enhanced.

However, if there is no need to enhance the appearance, as shown in FIG. 4, even if the top end of the square bracket-shaped element 23 is connected to a portion of the first line 221 where the first line 221 extends along the upper side of the side glass 1, the reception performance is unaffected.

<Dummy Element>

Figure 2:
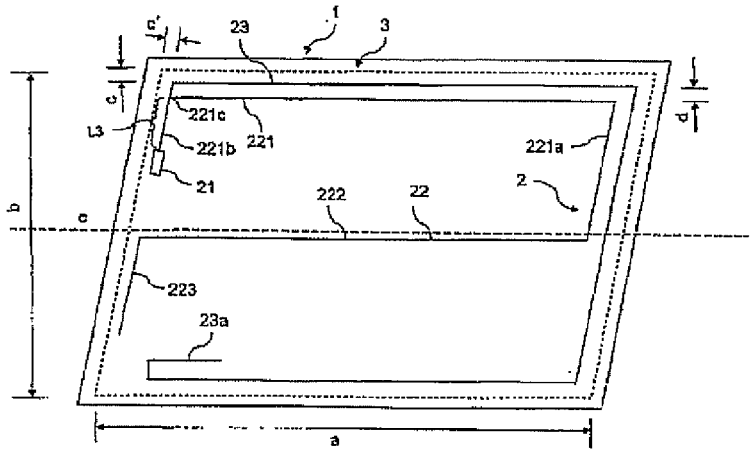
FIG. 2 is a front view of a glass antenna for the vehicle according to an embodiment 2.

The dummy element 24 is an element that does not affect a performance of the glass antenna 2 and is an element provided to enhance the appearance of the glass antenna 2 of the present invention. Thus, if there is no need to consider enhancing the appearance, as shown in FIG. 2, no dummy element is provided.

As shown in FIG. 1, the dummy element 24 is not connected to the main element 22 nor the square bracket-shaped element 23. The dummy element 24 is arranged so as to extend along a part of the square bracket-shaped element 23 where the square bracket-shaped element 23 does not extend along the main element 22. When the dummy element 24 is provided, since each side of the side glass 1 except the side of the power feeding portion 21 looks as if a double frame is disposed, it is possible to enhance the appearance of the glass antenna, as compared with the case where the dummy element 24 is not provided.

<Clearance Between Flange and Square Bracket-Shaped Element and Distance Between Square Bracket-Shaped Element and Each Element>

When a clearance between a flange peripheral edge 3 and the square bracket-shaped element 23 is 10 mm or more, it is possible to prevent a decrease of the reception gain of the glass antenna 2 due to an electrical influence from a vehicle body. Further, when a distance between the square bracket-shaped element 23 and the main element 22 is also 10 mm or more, it is possible to prevent a decrease of the reception gain of the glass antenna 2 which is caused by a mutual electrical influence between the square bracket-shaped element 23 and the main element 22.

Here, the side glass 1 shown in FIGS. 1 to 9 is a side glass that is mounted on or fitted into a right side flange, when viewing the vehicle from a front, of the vehicle. As a matter of course, when the glass antenna of the present invention is provided on a side glass that is mounted on or fitted into a left side flange of the vehicle, as same as the case where the side glass 1 is mounted on or fitted into the right side flange and the glass antenna 2 of the present invention is provided on the side glass 1, a good performance can be obtained.

<Connection Between Power Feeding Portion and Power Feeding Line>

The glass antenna 2 is provided with a ground point (not shown) on the vehicle body in close proximity to the power feeding portion 21. Further, a receiver (not shown) and the ground point are connected by a coaxial cable (not shown). An outer sheath side of the coaxial cable is grounded or earthed, while a core wire side of the coaxial cable is connected to an AV line (not shown), then the ground point and the power feeding portion 21 are connected.

<Forming Method of Each Line of the Present Invention>

The glass antenna 2 can be formed using a generally used conductive ceramic paste which is the same conductive ceramic paste used when forming a defogger of a rear glass of the vehicle. The pattern of the glass antenna 2 can be formed by printing the conductive ceramic paste and burning or baking the printed conductive ceramic paste in a heating furnace, which is same as a forming method of the defogger. Or alternatively, a pattern is printed on a bright film (a transparent film) with a conductive paint, then this printed pattern is pasted on the side glass 1, thereby forming the pattern of the glass antenna 2.

EMBODIMENTS

In the following description, each embodiment of the present invention will be explained.

Embodiment 1

FIG. 1 is a front view of a glass antenna according to an embodiment 1 of the present invention, when viewed from a vehicle exterior side. A glass antenna 2 of the embodiment 1 has a power feeding portion 21, a main element 22 and a square bracket-shaped element 23 on the side glass 1 that is mounted on or fitted into a side flange of a vehicle. Further, the glass antenna 2 has a dummy element 24.

The power feeding portion 21 is provided at a left side portion of the side glass 1. One end of the main element 22 is connected to the power feeding portion 21, and the other end of the main element 22 is open. With regard to the square bracket-shaped element 23, its one end is connected to some midpoint of the main element 22, and the square bracket-shaped element 23 is arranged at the outer side of the main element 22 so as to extend along a periphery of the side glass 1. The dummy element 24 is arranged so as to extend along a part of the square bracket-shaped element 23 where the square bracket-shaped element 23 does not extend along the main element 22.

The main element 22 has a first line 221, a second line 222 and a third line 223.

The first line 221 is arranged at the upper side of the side glass 1, and left and right end portions of the first line 221 are bent. A first bending portion 221*a* of the first line 221, which is disposed so as to extend along a right side of the side glass 1, and a second bending portion 221*b* of the first line 221, which is disposed so as to extend along a left side of the side glass 1, are formed on the side glass 1. A top end of the first bending portion 221*a* of the first line 221 is connected to one end of the second line 222, and a top end of the second bending portion 221*b* of the first line 221 is connected to the power feeding portion 21.

The second line 222 is a line that is parallel to the upper side of the side glass 1 and is positioned and extends in close proximity to a center line e of the side glass 1 and also reaches up to both left and right sides of the side glass 1. The one end of the second line 222 is connected to the top end of the first bending portion 221*a* of the first line 221, and another one end (the other end) of the second line 222 is connected to a top end of the third line 223.

The third line 223 is arranged so as to extend along the left side of the side glass 1. One end of the third line 223 is connected to the top end of the second line 222, and the third line 223 is elongated in a direction moving away from the power feeding portion 21, then another one end (the other end) of the third line 223 is open.

The square bracket-shaped element 23 is connected to a bending point 221*c* of the second bending portion 221*b* of the first line 221 of the main element 22. Further, the square bracket-shaped element 23 is elongated along the upper side of the side glass 1 at the outer side of the first line 221, is bent at a right upper side portion corner part of the side glass 1, and is elongated along the right side of the side glass 1, and further is bent at a right lower side portion corner part of the side glass 1, then is elongated along the lower side of the side glass 1. Then, a top end portion of the square bracket-shaped element 23 is turned back, and a turning-back portion 23*a* of the square bracket-shaped element 23 is formed.

<Measurement Result when Adjusting Configuration of Antenna of Embodiment 1 in Accordance with Frequency Band of FM Broadcast Wave Outside Japan>

When adjusting a configuration of the glass antenna 2 of the present embodiment to properly receive the frequency band (88 MHz~108 MHz) of the FM broadcast wave outside Japan, each size is as follows.

- a lateral width a of flange=672 mm
- a longitudinal width b of flange=414 mm
- a length of main element 22=1541 mm
- a length obtained by adding a length of second bending portion 221*b* of main element 22 to a length of square bracket-shaped element 23=1697 mm
- a length of first bending portion 221*a* of main element 22=173 mm
- a length of second bending portion 221*b* of main element 22=67 mm
- a length of second line 222 of main element 22=588 mm
- a length of third line 223 of main element 22=130 mm
- a clearance c between square bracket-shaped element 23 and flange peripheral edge 3=10 mm
- a clearance c' between second bending portion 221*b* of main element 22 and flange peripheral edge 3=10 mm, and a clearance c' between third line 223 of main element 22 and flange peripheral edge 3=10 mm
- a distance d between main element 22 and square bracket-shaped element 23=20 mm
- a distance d' between dummy element 24 and square bracket-shaped element 23=20 mm Here, with regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha$=0.7, and also when a wavelength of a center frequency 103 MHz of a frequency band which is higher than the center frequency of the frequency band (88 MHz~108 MHz) of the FM broadcast wave outside Japan is $\lambda'$ and a wavelength of a center frequency 93 MHz of a frequency band which is lower than the center frequency of the frequency band (88 MHz~108 MHz) of the FM broadcast wave outside Japan is $\lambda$, $\alpha\cdot\lambda'\cdot 3/4$=1529 mm and $\alpha\cdot\lambda\cdot 3/4$=1694 mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

Figure 11:
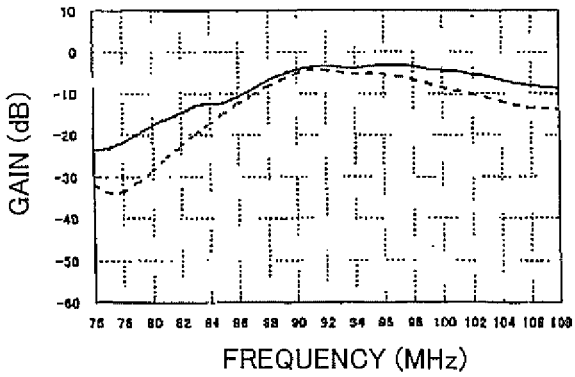
FIG. 11 is a frequency response characteristic with a reception gain at each frequency compared between the embodiment 1 and the comparative example.

When receiving the broadcast wave of the frequency 76 MHz~108 MHz of the FM frequency band inside and outside Japan by the glass antenna of the present embodiment formed in this way, a result shown in FIG. 11 was obtained.

FIG. 11 is the measurement result of the glass antenna 2 of the present embodiment and a glass antenna of an after-mentioned comparative example (which is an antenna that has only the main element 22 but does not have the square bracket-shaped element 23. A length of the main element 22 of the glass antenna is adjusted in accordance with the frequency band of the FM broadcast wave outside Japan.), and shows the reception gain at each frequency of 76 MHz~108 MHz. Here, the reception gain indicates an average of a reception gain obtained at each angle in all directions. In FIG. 11, a solid line indicates the measurement result of the glass antenna 2 of the present embodiment, and a broken line indicates the measurement result of the comparative example.

When viewing FIG. 11, in the frequency band (88 MHz~108 MHz) of the FM broadcast wave outside Japan, regarding the measurement result of the comparative example indicated by the broken line, although the reception gain is a maximum at 92 MHz, the reception gain greatly decreases with increase of the frequency from this frequency. On the other hand, as for the glass antenna 2 of the present embodiment, the reception gain is almost constant at 90 MHz~98 MHz. In addition, the decrease of the reception gain is small even at a higher frequency than 98 MHz. It is understood that a high reception gain can be obtained over the full range of the frequency band (88 MHz~108 MHz) of the FM broadcast wave outside Japan.

As described above, by properly adjusting the connecting point of the square bracket-shaped element 23 with the main element 22 and properly adjusting the length of each element, the excellent reception of the FM broadcast wave can be achieved at the frequency band (88 MHz~108 MHz) of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Embodiment 2

FIG. 2 is a front view of a glass antenna according to an embodiment 2 of the present invention, when viewed from the vehicle exterior side. The glass antenna of the embodiment 2 is different from the glass antenna of the embodiment 1 in the respect that the glass antenna of the embodiment 2 does not have the dummy element 24. The glass antenna of the embodiment 2 is the same as the glass antenna of the embodiment 1 except for this respect.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Embodiment 3

FIG. 3 is a front view of a glass antenna according to an embodiment 3 of the present invention, when viewed from the vehicle exterior side. The glass antenna of the embodiment 3 is different from the glass antenna of the embodiment 1 in the respect that the top end portion of the square bracket-shaped element 23 is not turned back. The reason why the top end portion of the square bracket-shaped element 23 is not turned back in this manner is because a size of the side glass 1 on which the glass antenna of the embodiment 3 is provided is greater than a size of the side glass 1 on which the glass antenna of the embodiment 1 is provided.

With regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha=0.7$, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot 3/4=1529$ mm and $\alpha\cdot\lambda\cdot 3/4=1694$ mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Embodiment 4

FIG. 4 is a front view of a glass antenna according to an embodiment 4 of the present invention, when viewed from the vehicle exterior side. The glass antenna of the embodiment 4 is different from the glass antenna of the embodiment 3 in the respect that the power feeding portion 21 is disposed at a left side upper portion corner part of the side glass 1 and the first line 221 of the main element 22 is thus not bent along the left side of the side glass 1, which does not form the second bending portion 221*b* of the first line 221, and the top end of the square bracket-shaped element 23 is connected to some midpoint of the first line 221.

With regard to the length of the main element 22 and the length obtained by adding the length from the power feeding portion 21 up to the connecting point between the main element 22 and the square bracket-shaped element 23 to the length of the square bracket-shaped element 23, when the wavelength shortening coefficient (or the wavelength compaction ratio) $\alpha=0.7$, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot\frac{3}{4}=1529$ mm and $\alpha\cdot\lambda\cdot\frac{3}{4}=1694$ mm. The length of the main element 22 and the length obtained by adding the length from the power feeding portion 21 up to the connecting point between the main element 22 and the square bracket-shaped element 23 to the length of the square bracket-shaped element 23 are adjusted to become almost these lengths 1529 mm and 1694 mm respectively.

Further, in addition to the adjustment of the length of the main element 22 and the length obtained by adding the length from the power feeding portion 21 up to the connecting point between the main element 22 and the square bracket-shaped element 23 to the length of the square bracket-shaped element 23, the length from the power feeding portion 21 up to the connecting point between the main element 22 and the square bracket-shaped element 23 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length from the power feeding portion 21 up to the connecting point between the main element 22 and the square bracket-shaped element 23 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length from the power feeding portion 21 up to the connecting point between the main element 22 and the square bracket-shaped element 23 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Embodiment 5

FIG. 5 is a front view of a glass antenna according to an embodiment 5 of the present invention, when viewed from the vehicle exterior side. The glass antenna of the embodiment 5 is different from the glass antenna of the embodiment 1 in the respect that a top end portion of the third line 223 of the main element 22 is bent to an inner side with respect to the third line 223, which forms a bending portion 223*a* of the third line 223, and the top end portion of the square bracket-shaped element 23 is turned back at an outer side of the square bracket-shaped element 23, which forms the turning-back portion 23*a* of the square bracket-shaped element 23, and two dummy elements 24 are provided. The reason why the top end portion of the third line 223 of the main element 22 is bent in this manner is because a size of the side glass 1 on which the glass antenna of the embodiment 5 is provided is smaller than the size of the side glass 1 on which the glass antenna of the embodiment 1 is provided.

With regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha$=0.7, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot 3/4$=1529 mm and $\alpha\cdot\lambda\cdot 3/4$=1694 mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Embodiment 6

FIG. 6 is a front view of a glass antenna according to an embodiment 6 of the present invention, when viewed from the vehicle exterior side. The glass antenna of the embodiment 6 is different from the glass antenna of the embodiment 1 in the respect that the second line 222 of the main element 22 is greatly separate from the center line e of the side glass 1 and is shifted to the lower side of the side glass 1 as compared with the second line 222 of the embodiment 1.

With regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha$=0.7, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot 3/4$=1529 mm and $\alpha\cdot\lambda\cdot 3/4$=1694 mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

In the glass antenna of the present embodiment, the second line 222 of the main element 22 is greatly separate from the center line e of the side glass 1 and is shifted to the lower side of the side glass 1 as compared with the second line 222 of the embodiment 1, then the second line 222 of the main element 22 is close to a part of the square bracket-shaped element 23 where the square bracket-shaped element 23 extends along the lower side of the side glass 1. Thus, the reception effective area for the AM broadcast wave becomes small as compared with the glass antenna of the embodiment 1. Although the glass antenna of the present embodiment can adequately receive the AM broadcast wave, the glass antenna of the present embodiment can not receive the AM broadcast wave as excellently as the glass antenna of the embodiment 1 receives the AM broadcast wave.

Embodiment 7

FIG. 7 is a front view of a glass antenna according to an embodiment 7 of the present invention, when viewed from the vehicle exterior side. The glass antenna of the embodiment 7 is different from the glass antenna of the embodiment 1 in the respect that the second line 222 of the main element 22 is greatly separate from the center line e of the side glass 1 and is shifted to the upper side of the side glass 1 as compared with the second line 222 of the embodiment 1.

With regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha=0.7$, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot\frac{3}{4}=1529$ mm and $\alpha\cdot\lambda\cdot\frac{3}{4}=1694$ mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

In the glass antenna of the present embodiment, the second line 222 of the main element 22 is greatly separate from the center line e of the side glass 1 and is shifted to the upper side of the side glass 1 as compared with the second line 222 of the embodiment 1, then the second line 222 of the main element 22 is close to a part of the first line 221 of the main element 22 where the first line 221 of the main element 22 extends along the upper side of the side glass 1. Thus, the reception effective area for the AM broadcast wave becomes small as compared with the glass antenna of the embodiment 1. Although the glass antenna of the present embodiment can adequately receive the AM broadcast wave, the glass antenna of the present embodiment can not receive the AM broadcast wave as excellently as the glass antenna of the embodiment 1 receives the AM broadcast wave.

Embodiment 8

FIG. 8 is a front view of a glass antenna according to an embodiment 8 of the present invention, when viewed from the vehicle exterior side. The glass antenna of the embodiment 8 is an antenna that is obtained by arranging each element of the glass antenna of the embodiment 1 to be symmetrical about a center point of the side glass 1.

With regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha=0.7$, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot 3/4=1529$ mm and $\alpha\cdot\lambda\cdot 3/4=1694$ mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Embodiment 9

FIG. 9 is a front view of a glass antenna according to an embodiment 9 of the present invention, when viewed from the vehicle exterior side. The glass antenna of the embodiment 9 is an antenna that is obtained by arranging each element of the glass antenna of the embodiment 8 to be symmetrical about the center line e of the side glass 1.

With regard to the length of the main element 22 and the length obtained by adding the length of the second bending portion 221*b* of the main element 22 to the length of the square bracket-shaped element 23, when the wavelength shortening coefficient (or the wavelength compaction ratio) $\alpha=0.7$, and also when the wavelength of the center frequency 103 MHz of the frequency band which is higher than the center frequency of the frequency band (88 MHz~108 MHz) of the FM broadcast wave outside Japan is $\lambda'$ and the wavelength of the center frequency 93 MHz of the frequency band which is lower than the center frequency of the frequency band (88 MHz~108 MHz) of the FM broadcast wave outside Japan is $\lambda$, $\alpha\cdot\lambda'\cdot 3/4=1529$ mm and $\alpha\cdot\lambda\cdot 3/4=1694$ mm. The length of the main element 22 and the length obtained by adding the length of the second bending portion 221*b* of the main element 22 to the length of the square bracket-shaped element 23 are adjusted to become almost these lengths 1529 mm and 1694 mm respectively.

Further, in addition to the adjustment of the length of the main element 22 and the length obtained by adding the length of the second bending portion 221*b* of the main element 22 to the length of the square bracket-shaped element 23, the length of the second bending portion 221*b* of the main element 22 is also adjusted, then these adjustment is made so that the reception gain of the antenna of the present embodiment becomes a maximum.

A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 88 MHz~108 MHz of the FM frequency band outside Japan by the glass antenna of the present embodiment formed in this way, as same as the glass antenna of the embodiment 1, a good reception performance can be obtained at the frequency band of the FM broadcast wave outside Japan.

In the glass antenna of the present embodiment, the length of the main element 22 is adjusted in accordance with the center frequency of the frequency band which is higher than the center frequency of the frequency band of the FM broadcast wave outside Japan, whereas the length obtained by adding the length of the second bending portion 221*b* of the main element 22 to the length of the square bracket-shaped element 23 is adjusted in accordance with the center frequency of the frequency band which is lower than the center frequency of the frequency band of the FM broadcast wave outside Japan. However, even if the length of the main element 22 is adjusted in accordance with the center frequency of the frequency band which is lower than the center frequency of the frequency band of the FM broadcast wave outside Japan and the length obtained by adding the length of the second bending portion 221*b* of the main element 22 to the length of the square bracket-shaped element 23 is adjusted in accordance with the center frequency of the frequency band which is higher than the center frequency of the frequency band of the FM broadcast wave outside Japan, the excellent reception of the FM broadcast wave can be possible at the frequency band of the FM broadcast wave outside Japan.

Further, in the glass antenna of the present embodiment, although the connecting point of the square bracket-shaped element 23 with the main element 22 and the length of each element are adjusted so that the reception gain becomes a maximum at the frequency band of the FM broadcast wave outside Japan, if the connecting point of the square bracket-shaped element 23 with the main element 22 and the length of each element are adjusted so that the reception gain becomes a maximum at the frequency band of the FM broadcast wave inside Japan, as same as the glass antenna of the present embodiment, the excellent reception of the FM broadcast wave can be possible at the frequency band of the FM broadcast wave inside Japan.

Furthermore, in the glass antenna of the present embodiment, the second line 222 of the main element 22 is arranged so as to extend along the center line e of the side glass 1. Thus, the reception effective area for the AM broadcast wave can be increased, thereby also excellently receiving the AM broadcast wave by the glass antenna of the present embodiment.

Although the present invention has been described above by reference to certain embodiments of the invention, the present invention is not limited to the embodiments described above. Modifications and variations of the embodiments described above can be possible as the present invention.

Comparative Example

Figure 10:
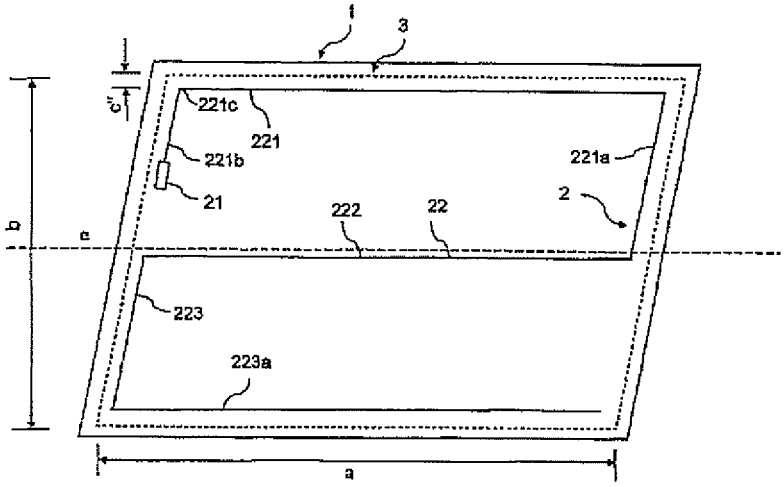
FIG. 10 is a front view of a glass antenna for the vehicle of a comparative example.

FIG. 10 is a front view of a glass antenna according to the comparative example of the present invention, when viewed from the vehicle exterior side. A glass antenna 2 of the comparative example has only the power feeding portion 21 and the main element 22 on the side glass 1 that is mounted on or fitted into the side flange of the vehicle. The glass antenna 2 of the comparative example is a well-known FM frequency band glass antenna provided on the side glass.

The power feeding portion 21 is provided at the left side portion of the side glass 1. One end of the main element 22 is connected to the power feeding portion 21, and the other end of the main element 22 is open.

The main element 22 is formed into an inverted S-shape, and has the first line 221, the second line 222 and the third line 223.

The first line 221 is arranged at the upper side of the side glass 1, and left and right end portions of the first line 221 are bent. The first bending portion 221*a* of the first line 221, which is disposed so as to extend along a right side of the side glass 1, and the second bending portion 221*b* of the first line 221, which is disposed so as to extend along a left side of the side glass 1, are formed on the side glass 1. The top end of the first bending portion 221*a* of the first line 221 is connected to one end of the second line 222, and the top end of the second bending portion 221*b* of the first line 221 is connected to the power feeding portion 21.

The second line 222 is a line that is parallel to the upper side of the side glass 1 and is positioned and extends in close proximity to a center line e of the side glass 1 and also reaches up to both left and right sides of the side glass 1. The one end of the second line 222 is connected to the top end of the first bending portion 221*a* of the first line 221, and another one end (the other end) of the second line 222 is connected to the top end of the third line 223.

The third line 223 is arranged so as to extend along the left side of the side glass 1. One end of the third line 223 is connected to the top end of the second line 222, and the third line 223 is elongated in a direction moving away from the power feeding portion 21. Another one end (the other end) of the third line 223 is bent, and forms the bending portion 223*a* of the third line 223.

<Measurement Result when Adjusting Configuration of Antenna of Comparative Example in Accordance with Frequency Band of FM Broadcast Wave Outside Japan>

When adjusting a configuration of the glass antenna 2 of the comparative example to properly receive the frequency band (88 MHz~108 MHz) of the FM broadcast wave outside Japan, each size is as follows.

a lateral width a of flange=672 mm
a longitudinal width b of flange=414 mm
a length of main element 22=2234 mm
a length of first bending portion 221*a* of main element 22=200 mm
a length of second bending portion 221*b* of main element 22=86 mm
a length of second line 222 of main element 22=610 mm
a length of third line 223 of main element 22=757 mm
a length of bending portion 223*a* of third line 223 of main element 22=170 mm
a clearance c" between main element 22 and flange peripheral edge 3=10 mm A pattern of the glass antenna of the present embodiment is printed on the side glass 1 on a vehicle interior side with the conductive ceramic paste so that each line width is 0.5 mm, and after drying the pattern (after the pattern dries), the printed conductive ceramic paste is burned or baked in the heating furnace. Further, the AV line is fixed to the power feeding portion 21, and the side glass 1 on which the pattern of the glass antenna is provided is mounted to the vehicle body. Furthermore, an outer sheath conductive line of the coaxial cable that extends from a tuner (not shown) is grounded or earthed at the ground point provided on the vehicle body in close proximity to the power feeding portion, while the core wire side of the coaxial cable is connected to the AV line.

When receiving the broadcast wave of the frequency 76 MHz~108 MHz of the FM frequency band inside and outside Japan by the glass antenna of the comparative example formed in this way, the result shown in FIG. 11 was obtained.

FIG. 11 is the measurement result of the glass antenna 2 of the comparative example and the glass antenna 2 of the embodiment 1, and shows the reception gain at each frequency of 76 MHz~108 MHz. Here, the reception gain indicates an average of a reception gain obtained at each angle in all directions. In FIG. 11, the solid line indicates the measurement result of the glass antenna 2 of the embodiment 1, and the broken line indicates the measurement result of the comparative example.

From FIG. 11, with respect to the glass antenna of the embodiment 1, a high reception gain can be obtained over the full range of the frequency band (88 MHz~108 MHz) of the FM broadcast wave outside Japan. However, as for the glass antenna of the comparative example, a high reception gain can be obtained only at 92 MHz, and a high reception gain can not be obtained over the full range of the frequency band (88 MHz~108 MHz) of the FM broadcast wave outside Japan.

Reference Example

FIGS. 12A and 12B are reference examples for explaining the reception effective area of the glass antenna for AM broadcast wave. In FIG. 12A, the second line 222 of the main element 22, which forms the glass antenna 2, is arranged so as to extend along the center line e of the side glass 1. In FIG. 12B, the second line 222 of the main element 22 is arranged in close proximity to the bending portion 223*a* of the third line 223.

As shown by the circle drawn by the dotted line which encircles each line, which forms the glass antenna 2, in FIGS. 12A and 12B, each line forming the glass antenna 2 has a certain reception effective area. Therefore, when the lines forming the glass antenna 2 are arranged so that the reception effective area of each line does not overlap with each other as shown in FIG. 12A, the glass antenna 2 can have a great reception effective area for the AM broadcast wave, as compared with the case in which the lines are arranged close to each other like the second line 222 of the main element 22 and the bending portion 223*a* of the third line 223 as shown in FIG. 12B.

EXPLANATION OF REFERENCE

1 . . . side glass
2 . . . glass antenna
21 . . . power feeding portion
22 . . . main element
221 . . . first line
221*a* . . . first bending portion of first line
221*b* . . . second bending portion of first line
221*c* . . . bending point of second bending portion of first line
222 . . . second line
223 . . . third line
223*a* . . . bending portion of third line
23 . . . square bracket-shaped element
23*a* . . . turning-back portion of square bracket-shaped element
24 . . . dummy element
3 . . . flange peripheral edge
a . . . lateral width of flange
b . . . longitudinal width of flange
c . . . clearance between square bracket-shaped element and flange peripheral edge
c' . . . clearance between second bending portion of main element and flange peripheral edge, and clearance between third line of main element and flange peripheral edge
c" . . . clearance between main element and flange peripheral edge in comparative example
d . . . distance between main element and square bracket-shaped element d' . . . distance between dummy element and square bracket-shaped element e . . . center line of side glass

The invention claimed is:

1. A glass antenna of a vehicle for receiving FM broadcast wave and AM broadcast wave comprising:

a power feeding portion provided at a first lateral side portion of a side glass of the vehicle;

a main element connected to the power feeding portion, the main element having;

(a) a first line arranged along an upper side or a lower side of the side glass and extending straight in a lateral direction from the power feeding portion to a first end of a first bending portion arranged along a second lateral side of the side glass opposite the first lateral side of the side glass;

(b) a second line having a first end is connected to a second end of the first bending portion opposite the first end of the first bending portion, the second line extending straight in the lateral direction from the second lateral side portion up to the first lateral side portion of the side glass substantially on a center line of the side glass; and (c) a third line arranged in a longitudinal direction along the first lateral side portion of the side glass, a first end of the third line being connected to a second end of the second line, and a second end of the third line being open; and a square bracket-shaped element having two parallel portions connected by a third portion there between, the square bracket-shaped element being arranged along a periphery of the side glass outside of the main element, one of the two parallel portions being arranged along the upper side of the side glass, the other of the two parallel portions being arranged along the lower side of the side glass, and the third portion being arranged along the second lateral side of the side glass, a first end of the square bracket-shaped element being connected to a connecting point of some midpoint of the main element, and when a wavelength of a center frequency of frequency band of a low frequency with respect to a center frequency of frequency band of the FM broadcast wave received by the glass antenna is X and a wavelength of a center frequency of frequency band of a high frequency with respect to the center frequency of frequency band of the FM broadcast wave received by the glass antenna is X', and also when a wavelength shortening coefficient of the side glass is a, and further when a length of the main element is L1, a length of the square bracket shaped element is L2 and a length from the some midpoint of the main element at which the square bracket-shaped element is connected up to the power feeding portion is L3, these L1, L2 and L3 being set so as to substantially satisfy a following relationship;

$$L1=\alpha*\lambda*\tfrac{3}{4}, L2+L3=\alpha*\lambda'*\tfrac{3}{4}$$

or $$L1=\alpha*\lambda'*\tfrac{3}{4}, L2+L3=\alpha*\lambda*\tfrac{3}{4}.$$

2. The glass antenna of the vehicle as claimed in claim 1, wherein:

a dummy element is arranged parallel to a part of the square bracket-shaped element in a region of the side glass remote from the main element.

3. The glass antenna of the vehicle as claimed in claim 1, wherein:

the square bracket-shaped element is arranged at a clearance of 10 mm or more from a flange peripheral edge of the vehicle where the side glass is mounted.

4. The glass antenna of the vehicle as claimed in claim 1, wherein:

a part of the square bracket-shaped element which extends along the main element is arranged at a distance of 10 mm or more from the main element.

* * * * *